US009348279B1

(12) United States Patent
Ito et al.

(10) Patent No.: US 9,348,279 B1
(45) Date of Patent: May 24, 2016

(54) SURFACE HEATER, FIXING DEVICE, AND IMAGE FORMING APPARATUS

(71) Applicant: FUJI XEROX CO., LTD., Tokyo (JP)

(72) Inventors: Kazuyoshi Ito, Kanagawa (JP); Mitsuhiro Matsumoto, Kanagawa (JP); Mikio Saiki, Kanagawa (JP); Yasuhiro Uehara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/852,804

(22) Filed: Sep. 14, 2015

(30) Foreign Application Priority Data

Mar. 12, 2015 (JP) ..... 2015-049593

(51) Int. Cl.
*G03G 15/20* (2006.01)

(52) U.S. Cl.
CPC ..... *G03G 15/2053* (2013.01); *G03G 15/2017* (2013.01)

(58) Field of Classification Search
CPC ..... G03G 15/2017; G03G 15/2039; G03G 15/2042; G03G 15/2053; G03G 2215/2016; G03G 2215/2035
See application file for complete search history.

(56) References Cited

U.S. PATENT DOCUMENTS 8,107,857 B2 * 1/2012 Kobayashi ..... G03G 15/2064 399/122
8,406,668 B2 3/2013 Kageyama
9,217,971 B1 * 12/2015 Matsumoto ..... G03G 15/206
2003/0063931 A1 * 4/2003 Sanpei ..... G03G 15/2053 399/328
2003/0147680 A1 * 8/2003 Kawamura ..... G03G 15/2064 399/329
2012/0093546 A1 * 4/2012 Ohara ..... G03G 15/2017 399/329
2012/0308278 A1 * 12/2012 Kikuchi ..... G03G 15/2053 399/329
2015/0030360 A1 * 1/2015 Saiki ..... G03G 15/2064 399/329
2015/0098737 A1 * 4/2015 Matsumoto ..... G03G 15/2053 399/329
2015/0160590 A1 * 6/2015 Matsumoto ..... G03G 15/2089 399/329

FOREIGN PATENT DOCUMENTS

JP 2008-170886 A 7/2008
JP 2009-258243 A 11/2009
JP 2010-177142 A 8/2010

* cited by examiner

*Primary Examiner* — Ryan Walsh
(74) *Attorney, Agent, or Firm* — Sughrue Mion, PLLC

(57) ABSTRACT

A surface heater includes a heating body, insulation layers, and a first support layer and a second support layer. The heating body is interposed between the insulation layers. The heating body and the insulation layers are interposed between the first support layer and the second support layer. The first support layer has a first region superposed on the heating body and a second region not superposed on the heating body. The first support layer has at least one slit which is located at a side of an inner circumferential surface of the surface heater bent into an arc shape. The second region has the at least one slit and the first region has no slit, or the at least one slit includes a plurality of slits and the second region has a greater number of slits out of the plurality of slits than the first region has.

8 Claims, 6 Drawing Sheets

SURFACE HEATER, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-049593 filed Mar. 12, 2015.

BACKGROUND

Technical Field

The present invention relates to a surface heater, a fixing device, and an image forming apparatus.

SUMMARY

According to an aspect of the present invention, a surface heater includes a heating body, insulation layers, and a first support layer and a second support layer. The heating body is interposed between the insulation layers. The heating body and the insulation layers are interposed between the first support layer and the second support layer. The first support layer has a first region superposed on the heating body and a second region not superposed on the heating body. The first support layer has at least one slit which is located at a side of an inner circumferential surface of the surface heater bent into an arc shape. The second region has the at least one slit and the first region has no slit, or the at least one slit includes a plurality of slits and the second region has a greater number of slits out of the plurality of slits than the first region has.

BRIEF DESCRIPTION OF THE DRAWINGS

Exemplary embodiment of the present invention will be described in detail based on the following figures, wherein.

DETAILED DESCRIPTION

Figure 1:
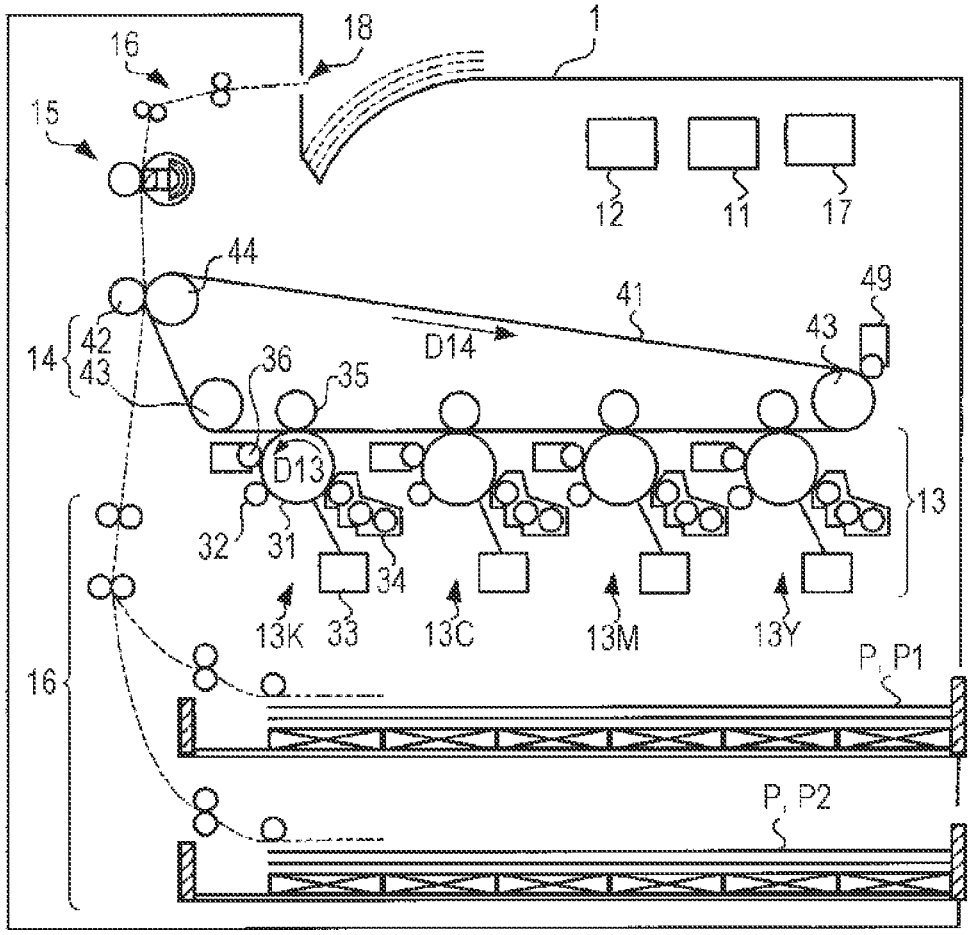
FIG. 1 illustrates an overall structure of an image forming apparatus.

FIG. 1 illustrates an overall structure of an image forming apparatus 1 according to an exemplary embodiment of the present invention. The image forming apparatus 1 forms images by using an electrophotographic system. The image forming apparatus 1 according to the present exemplary embodiment is of a so-called tandem-type and forms images on sheets of paper P in accordance with image data indicative of the images. Each of the sheets P serves as an example of a recording medium. Referring to FIG. 1, a controller 11 includes a central processing unit (CPU), a read only memory (ROM), and a random access memory (RAM). Computer programs (simply referred to as "programs" hereafter) stored in the ROM and a memory 12 are loaded into and executed by the CPU so that the controller 11 controls components of the image forming apparatus 1. The memory 12 is a large memory such as a hard disc drive and stores the programs to be loaded into the CPU of the controller 11. An operation unit 17 includes operation buttons and the like that allow various instructions to be input therethrough. The operation unit 17 accepts operations performed by a user and supplies signals corresponding to content of the operations to the controller 11.

Developing units 13Y, 13M, 13C, and 13K each form a toner image on the sheet P. Y, M, C, and K in reference signs indicate elements corresponding to yellow, magenta, cyan, and black, respectively. There are no big differences between the structures of the developing units 13Y, 13M, 13C, and 13K except for toner used therein. Hereafter, the developing units 13Y, 13M, 13C, and 13K may be simply referred to as the "developing units 13" by omitting the alphabetical characters at the ends of the reference signs of the developing units 13Y, 13M, 13C, and 13K indicating toner colors in the case where the developing unit 13Y, 13M, 13C, and 13K are not particularly distinguished from one another.

The developing units 13 each include a photosensitive drum 31, a charger 32, a light exposure device 33, a developing device 34, a first transfer roller 35, and a drum cleaner 36. The photosensitive drum 31 serving as an image holding body includes a charge generating layer and a charge transport layer and is rotated in an arrow D13 direction of FIG. 1 by a drive unit (not illustrated). The charger 32 charges a surface of the photosensitive drum 31. The light exposure device 33 includes components such as laser light source (not illustrated) and a polygon mirror (not illustrated). Under control of the controller 11, the light exposure device 33 radiates laser light corresponding to the image data toward the photosensitive drum 31 having been charged by the charger 32. Thus, a latent image is held by the photosensitive drum 31. This image data may be obtained by the controller 11 from an external device through a communication unit (not illustrated). Examples of the external device include, for example, a reading device that reads an original image, a memory that stores data indicative of images, and so forth.

The developing device 34 contains two-component developer that includes toner of one of the colors Y, M, C, and K and a magnetic carrier such as ferrite powder. When the tip of a magnetic brush formed on the developing device 34 is brought into contact with the surface of the photosensitive drum 31, the toner is attracted to portions of the surface of the photosensitive drum 31 having been exposed to light from the light exposure device 33, the exposed portions being image areas of an electrostatic latent image. Thus, an image is formed (developed) on the photosensitive drum 31.

The first transfer roller 35 generates a predetermined potential difference at a position where an intermediate transfer belt 41 of a transfer unit 14 faces the photosensitive drum 31. The image is transferred onto the intermediate transfer belt 41 by this potential difference. After the image has been transferred, the drum cleaner 36 removes the toner that has not been transferred and remains on the surface of the photosensitive drum 31, and removes static electricity from the surface of the photosensitive drum 31. That is, the drum cleaner 36 removes unnecessary toner and charge from the photosensitive drum 31 so as to prepare for the next image formation.

The transfer unit 14 includes the intermediate transfer belt 41, a second transfer roller 42, belt transport rollers 43, and a backup roller 44. The transfer unit 14 transfers the image formed by the developing unit 13 onto the sheet P of a sheet type predetermined in accordance with operation by the user.

The intermediate transfer belt 41 is an endless belt member and looped over the belt transport rollers 43 and the backup roller 44. At least one of the backup roller 44 and the belt transport rollers 43 includes a drive unit (not illustrated), thereby moving the intermediate transfer belt 41 in an arrow D14 direction of FIG. 1. The belt transport rollers 43 that do not include the drive unit or one of the belt transport rollers 43 and the backup roller 44 that do not include the drive unit are rotated by the movement of the intermediate transfer belt 41. When the intermediate transfer belt 41 is moved in the arrow D14 direction of FIG. 1 and rotated, the image on the intermediate transfer belt 41 is moved to a region nipped between the second transfer roller 42 and the backup roller 44.

The second transfer roller 42 transfers the image on the intermediate transfer belt 41 onto the sheet P having been transported from a transport unit 16 by the potential difference between the second transfer roller 42 and the intermediate transfer belt 41. A belt cleaner 49 removes the toner that has not been transferred and remains on a surface of the intermediate transfer belt 41. The transfer unit 14 and the transport unit 16 transport the sheet P onto which the image has been transferred (that is, the sheet P on which an unfixed image to be heat fixed to the recording medium has been formed) to a fixing unit 15. The developing units 13 and the transfer unit 14 are included in an example of an image forming section.

The fixing unit 15, which serves as an example of a fixing device, heat fixes the image transferred onto the sheet P. The structure of the fixing unit 15 will be described later. The transport unit 16 includes containers and transport rollers. The containers contain the sheets P cut into predetermined sizes. In an example of FIG. 1, two types of the sheets P, that is, sheets P1 and sheets P2 having a narrower width than that of the sheets P1 are used. The sheets P contained in the containers are picked up one after another by the transport rollers in accordance with an instruction from the controller 11 and each of the picked up sheets P is transported to the transfer unit 14 through a sheet transport path. The recording medium is not limited to paper. The recording medium may be, for example, a resin sheet or the like. In short, it is sufficient that the recording medium allow the image to be formed on a surface thereof.

Figure 2:
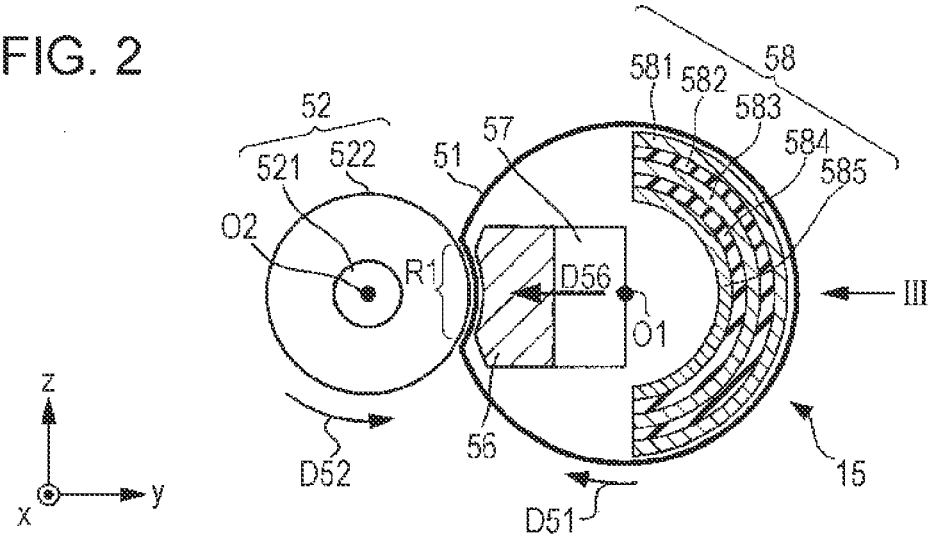
FIG. 2 illustrates an outline of a fixing unit.

FIG. 2 illustrates an outline of the fixing unit 15. Hereafter, for description of disposition of elements of the fixing unit 15, a space in which the elements are disposed is represented as an xyz right-handed coordinate space in, for example, FIG. 2. Furthermore, in the indication of coordinates illustrated in, for example, FIG. 2, a mark in which a dot exists in a blank circle indicates an arrow directed from the back side toward the front side of the page of the drawings. In the space, a direction extending along the x axis is referred to as an x axis direction. In the x axis direction, a direction in which the x component increases and a direction in which the x component decreases are respectively referred to as a +x direction and a −x direction. Also, a y axis direction, a +y direction, a −y direction are defined for the y component, and a z axis direction, a +z direction, and a −z direction are defined for the z component. Furthermore, when each of the sheets P passes through the fixing unit 15, the sheet P is transported in the z axis direction with a side thereof on which the image is formed faces the +y direction. That is, the z axis direction is a transport direction of the sheet P and the x axis direction is a width direction of the sheet P.

The fixing unit 15 includes a fixing belt 51, a pressure roller 52, a pressing pad 56, a holder 57, and a heating member 58. As illustrated in FIG. 2, the cylindrical fixing belt 51 is rotated in an arrow D51 direction about an axis O1 parallel to the x axis direction. Also as illustrated in FIG. 2, the pressure roller 52 includes a cylindrical metal core 521 and an elastic layer 522 provided on a surface of the core 521. The core 521 is rotated in an arrow D52 direction about an axis O2 that is parallel to the axis O1 and disposed on the −y side of the axis O1. The elastic layer 522 is rotated in the arrow D52 direction along with the core 521. The elastic layer 522 is formed of, for example, a silicone rubber layer or a fluorocarbon rubber layer. Furthermore, the elastic layer 522 may include a mold release surface layer (fluorocarbon resin layer) on its surface. The pressure roller 52 is rotated by a drive unit (not illustrated) while pressing the sheet P having been transported by the transport unit 16 against the fixing belt 51, thereby assisting the fixing belt 51 in heating the sheet P. A frictional force from the pressure roller 52 is utilized so as to rotate the fixing belt 51 by rotation of the pressure roller 52, thereby the sheet P transported from the transfer unit 14 is transported to an output opening 18.

The pressing pad 56, the holder 57, and the heating member 58 are disposed on an inner circumferential side of the fixing belt 51. The holder 57 is a bar-shaped member extending in the x axis direction. Both ends (not illustrated) of the holder 57 are supported by a housing of the image forming apparatus 1. The holder 57 is formed of, for example, a material such as heat-resistant resin such as glass-mixed polyphenylene-sulfide (PPS) or non-magnetic metal such as gold (Au), silver (Ag), aluminum (Al) or copper (Cu). The holder 57 is supported so that the holder 57 presses the pressing pad 56 in an arrow D56 direction (−y direction) of FIG. 2, that is, a direction toward the pressure roller 52.

The pressing pad 56 is formed of heat-resistant resin such as a liquid crystal polymer (LCP) and supported at a position facing the pressure roller 52 by the holder 57. The pressing pad 56 is disposed so as to be pressed by the pressure roller 52 with the fixing belt 51 interposed therebetween and presses the fixing belt 51 from inside toward the pressure roller 52 (−y direction). Thus, a nip region R1 is formed between the fixing belt 51 and the pressure roller 52. The sheet P is transported so as to pass through the nip region R1. The pressing pad 56 is deformed in the nip region R1 so as to be concaved toward the axis O1 by the pressure from the pressure roller 52. The shape of the fixing belt 51 follows the shape of this deformed pressing pad 56. The pressing pad 56 may be formed of an elastic body such as silicone rubber or fluorocarbon rubber. The pressing pad 56 is supported by the holder 57 so as not to be rotated. The fixing belt 51 is rotated while sliding on the pressing pad 56.

The heating member 58 is in contact with an inner circumference of the fixing belt 51 so as to heat the fixing belt 51. The heating member 58 includes a metal layer 581, an insulation layer 582, a metal layer 583, an insulation layer 584, and a metal layer 585, which are stacked one on top of another in this order from an inner circumferential surface side of the fixing belt 51 toward the axis O1. The heating member 58 has a shape formed as follows: that is, a rectangular plate-shaped member formed by stacking the metal layer 581, the insulation layer 582, the metal layer 583, the insulation layer 584, and the metal layer 585 is bent into an arc shape about the axis O1. The plane size of the heating member 58 before it is bent is, for example, about 100 mm×400 mm. The heating member 58 is formed by stacking the metal layer 581, the insulation layer 582, the metal layer 583, the insulation layer 584, and the metal layer 585, which have planar shapes, one on top of another, and then bending the resulting layered structure into an arc shape. Both the ends of the heating member 58 in the x axis direction are supported by the housing (not illustrated) of the image forming apparatus 1 so as not to be rotated, and the fixing belt 51 is rotated while sliding on an outer circumferential surface of the heating member 58.

The metal layer 581 is, for example, a stainless steel layer having a thickness of about 10 to 100 μm and included in an outer circumferential surface of the heating member 58. The metal layer 581 has the function of equalizing the temperature and the function of a heat reservoir. The metal layer 581 also has the function of preventing the metal layer 583 and the insulation layers 582 and 584 from rising or being separated due to thermal expansion by utilizing the stiffness of the metal layer 581. The metal layer 581 is in contact with the fixing belt 51 so as to support the fixing belt 51. Although examples of the shape of the metal layer 581 include a shape of a structure formed by cutting a portion corresponding to a range of a predetermined central angle (for example, 30 to 180°) from a cylindrical alloy having the above-described thickness, this is not limiting.

The metal layer 583 is formed on the inner circumference side of the metal layer 581 while being covered by the insulation layer 582. According to the present exemplary embodiment, the metal layer 583 extends in a direction intersecting the arrow D51 direction, which is a movement direction of the fixing belt 51 (the metal layer 583 extends in the longitudinal direction of the heating member 58).

Figure 3:
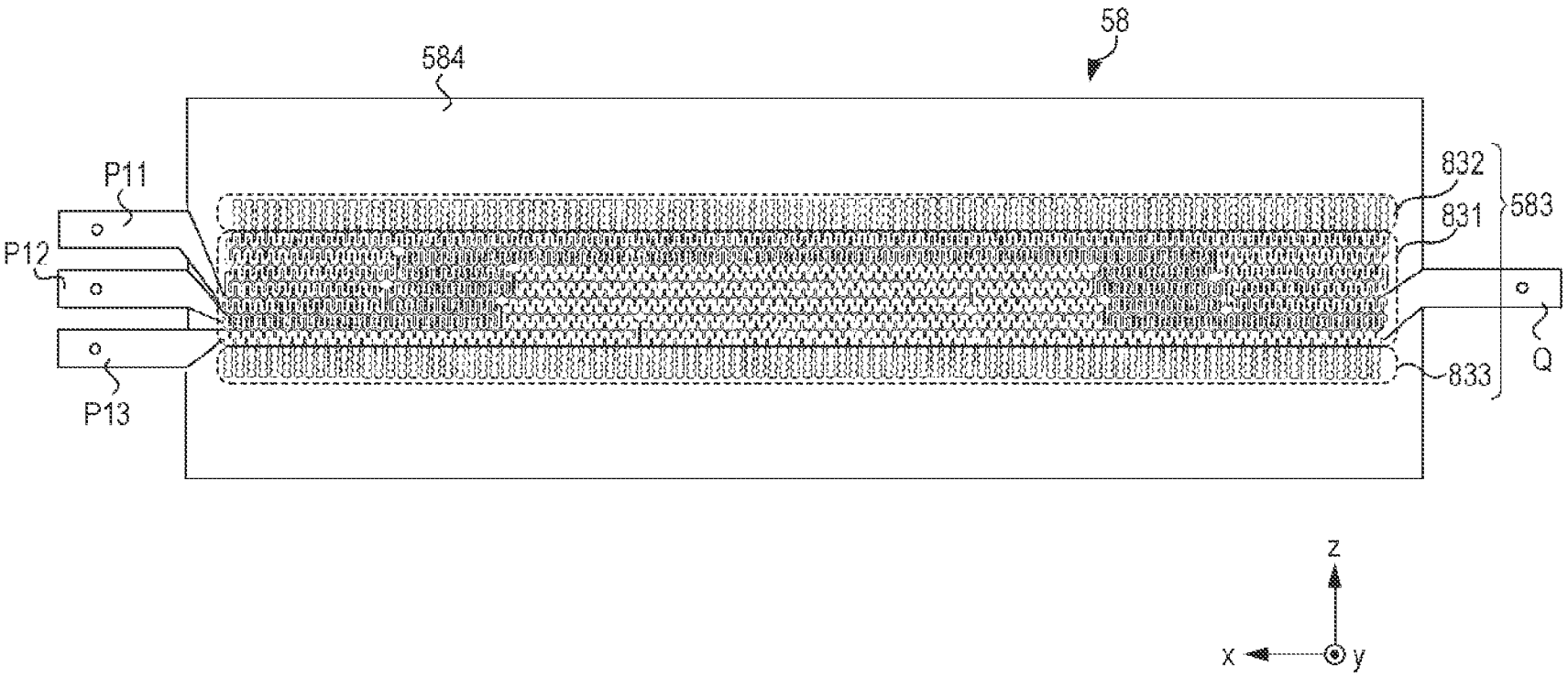
FIG. 3 illustrates a metal layer seen from an arrow III of FIG. 2.

FIG. 3 illustrates the metal layer 583 seen from an arrow III of FIG. 2 with the fixing belt 51, the metal layer 581, and the insulation layer 582 omitted. For clear understanding of the structure of the metal layer 583, FIG. 3 illustrates the metal layer 583 and the insulation layer 584 in the case where the heating member 58 has a planar shape without being bent. The metal layer 583 is formed by, for example, cutting a portion having a shape illustrated in FIG. 3 from a thin stainless steel sheet having a thickness of 10 to 100 μm. The material of the metal layer 583 may be other than the above-described material as long as that material generates heat. As illustrated in FIG. 3, the metal layer 583 is formed in part of the heating member 58 in the z axis direction.

As illustrated in FIG. 3, the metal layer 583 includes a heating portion 831 (an example of a heating body) and non-heating portions 832 and 833. As illustrated in FIG. 3, the heating portion 831 and the non-heating portions 832 and 833 are integrally formed to have a surface shape, and the metal layer 583 has a certain degree of stiffness. The metal layer 583 is provided with electrodes P11 to P13 and Q. A power source (not illustrated) is connected between each of the electrodes P11 to P13 and the electrode Q. When currents flow from these power sources, the heating portion 831 generates heat. When the heating portion 831 generates heat, a region of the metal layer 581 facing the heating portion 831 (referred to as "heating region" hereafter) is heated. The heat is conducted from this heating region to the fixing belt 51 in contact with the heating region, thereby heating the fixing belt 51. Although the non-heating portions 832 and 833 also slightly generate heat, a degree of heat capable of heating the fixing belt 51 is not generated in the non-heating portions 832 and 833.

Referring back to FIG. 2, the insulation layers 582 and 584 are disposed so that surfaces of the metal layer 583 (a surface on the fixing belt 51 side and a surface on the axis O1 side) are interposed therebetween. The insulation layers 582 and 584 are highly heat-resistant layers formed of, for example, polyimide resin, an insulating evaporated film, a thin-film ceramic, or the like having a thickness of 10 to 100 μm. The insulation layer 582 is provided on a lower surface side of the metal layer 581 and covers the metal layer 583 so as to protect the metal layer 583. The insulation layer 584 is provided on an upper surface side of the metal layer 585 and covers the metal layer 583 so as to protect the metal layer 583. The materials of the insulation layers 582 and 584 are not limited to polyimide resin. The insulation layers 582 and 584 may be formed of any heat-resistant material including, for example, resin other than polyimide resin.

The metal layer 585 is, for example, a copper layer having a thickness of about 10 to 100 μm and included in an inner circumferential surface of the heating member 58. The material of the metal layer 585 may be a material other than copper such as stainless steel. The metal layer 585 has the function of supporting the metal layer 583 and the insulation layers 582 and 584. The metal layer 585 also has the function of preventing the metal layer 583 and the insulation layers 582 and 584 from rising or being separated due to thermal expansion by utilizing the stiffness of the metal layer 585. Although examples of the shape of the metal layer 585 include a shape of a structure formed by cutting a portion corresponding to a range of a predetermined central angle (for example, 30 to 180°) from a cylindrical alloy having the above-described thickness, this is not limiting. The metal layers 581 and 585 are disposed so that surfaces of the metal layer 583 and the insulation layers 582 and 584 (surfaces on the fixing belt 51 side and surfaces on the axis O1 side), interposed therebetween, and each serve as an example of a support layer.

When forming the heating member 58 by bending the metal layer 581, the insulation layer 582, the metal layer 583, the insulation layer 584, and the metal layer 585, which have planar shapes, into an arc shape, a gap (rise or separation) may be formed between the insulation layer 584 and the metal layer 585 due to the difference in length in a circumferential direction (referred to as "arc length difference" hereafter) between the outer circumferential surface and the inner circumferential surface of the heating member 58. The metal layer 585 has plural slits (not illustrated) so as to compensate for this arc length difference and prevents the gap from being formed. Arrangement of the slits will be described later.

The metal layers 581 and 585, the insulation layers 582 and 584, and the metal layer 583 are entirely or partially bonded to one another by a thermoplastic adhesive at regions thereof other than the heating region or regions thereof not corresponding to the heating portion 831 (referred to as "non-heating regions" hereafter). That is, the metal layers 581 and 585, the insulation layers 582 and 584, and the metal layer 583 are bonded to one another at regions thereof not corresponding to a region where the heating portion 831 of FIG. 3 is positioned.

Figure 4A:
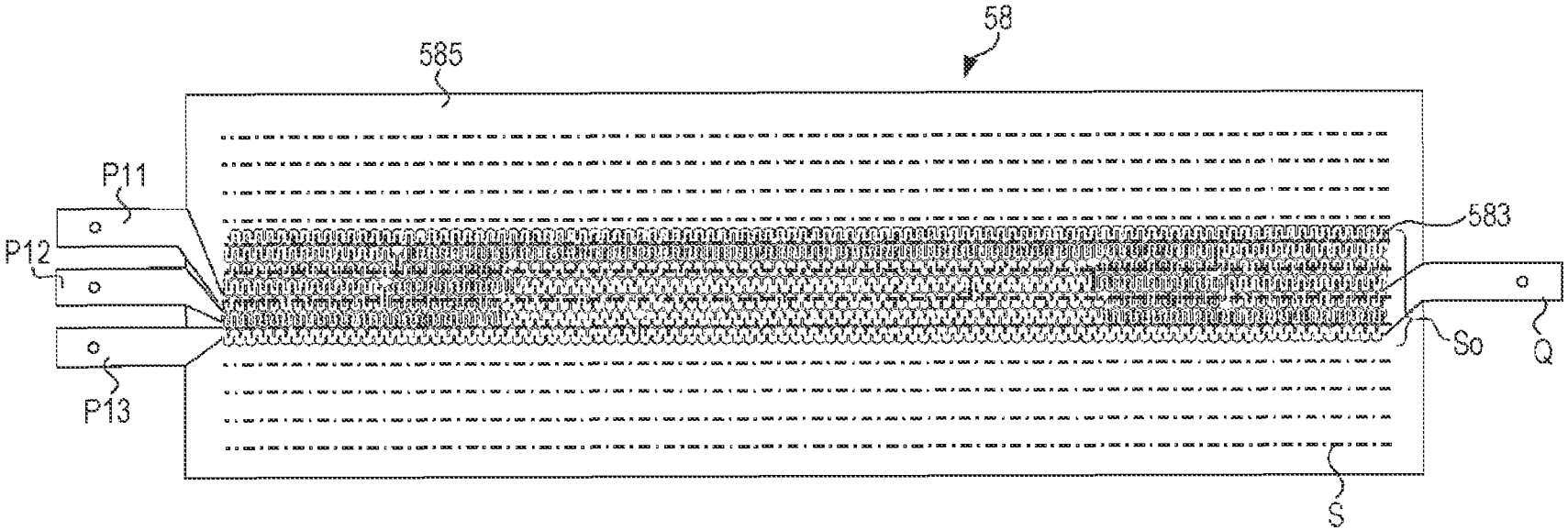
FIG. 4A illustrates arrangement of slits of a comparative example.
Figure 4B:
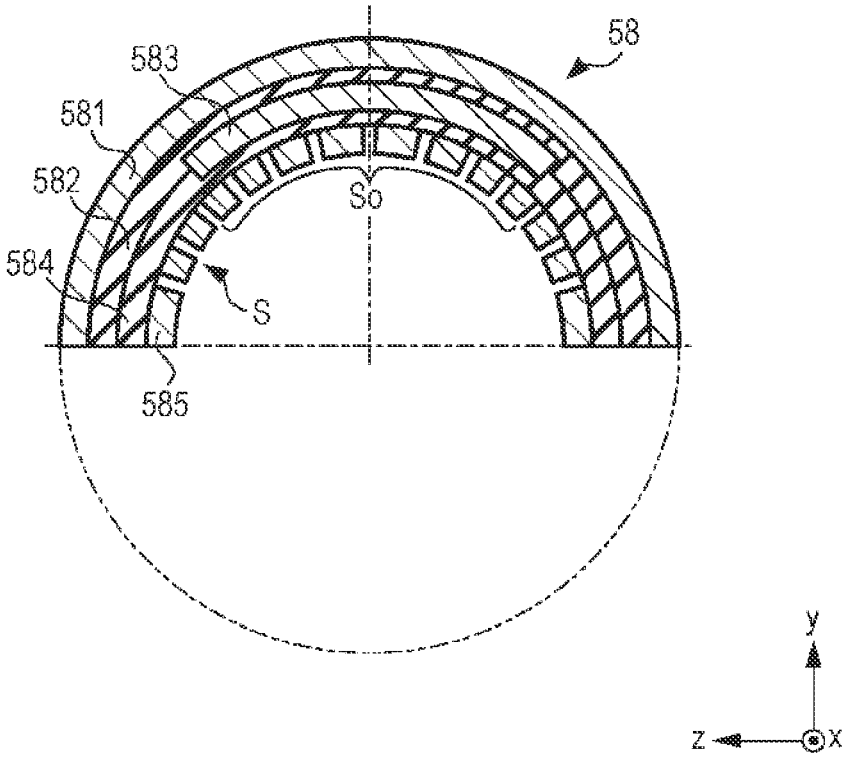
FIG. 4B illustrates the arrangement of the slits according to the comparative example.

FIGS. 4A and 4B illustrate arrangement of the slits according to a comparative example. Specifically, FIG. 4A is a view of the metal layers 583 and 585 seen in a similar or the same direction as that of FIG. 3 with the fixing belt 51, the metal layer 581, the insulation layer 582, and the insulation layer 584 omitted, and FIG. 4B is an enlarged sectional view of the heating member 58. Although slits S are indicated by dotted chain lines in FIG. 4A, the shape of the actual slits S is not the shape of the dotted chain lines but continuously extend in the longitudinal direction of the heating member 58. As illustrated in FIG. 4A, the slits S extend in the longitudinal direction of the heating member 58. Although the slits S are indicated by lines in FIG. 4A, the actual slits S have widths in the z axis direction. Furthermore, as illustrated in FIGS. 4A and 4B, the plural slits S are arranged in the circumferential direction of the heating member 58. For convenience of description, FIGS. 4A and 4B illustrate some of the slits S out of the slits S provided in the metal layer 585. The number of the slits S actually formed in the metal layer 585 is not limited to the number of slits S illustrated in FIGS. 4A and 4B. In an example of FIGS. 4A and 4B, some of the slits S (slits So) out of the plural slits S provided in the metal layer 585 are provided in a region superposed on the metal layer 583 when seen in a direction normal to the inner circumferential surface of the heating member 58.

As illustrated in FIGS. 4A and 4B, in the case where the slits S are superposed on the metal layer 583, the metal layer 585 may be separated from the insulation layer 584 from the slits So superposed on the metal layer 583 due to the difference in thermal expansion coefficient between the metal layer 585 and the insulation layer 584 occurring when the heating portion 831 generates heat. In this case, compared to a normal state (state in which the metal layer 585 is not separated from the insulation layer 584), a force of the metal layer 585 to support the metal layer 583 and the insulation layers 582 and 584 is reduced. Thus, the rise, the separation, and the like may occur due to thermal expansion of the metal layer 583 and the insulation layers 582 and 584. When the insulation layer 582 or 584 rises or is separated, the heating portion 831 heats itself (that is, heating without an object to be heated). Furthermore, when the metal layer 585 is separated from the insulation layer 584, the heat generated by the heating portion 831 is unlikely to be conducted to the metal layer 585. This further increases the temperature of the heating portion 831. As a result, changes such as embrittlement or carbonization may occur in the insulation layers 582 and 584. In this case, the insulating function is reduced, and accordingly, the currents flowing through the metal layer 583 leak to the metal layers 581 and 585, and a low resistance region is formed in the circuit. Thus, there may be problems such as abnormal heating due to reduction of combined resistance of the heating portion 831. There may also be problems such as poor contact of a temperature sensor (not illustrated) that detects the temperature of the heating portion 831.

Figure 5A:
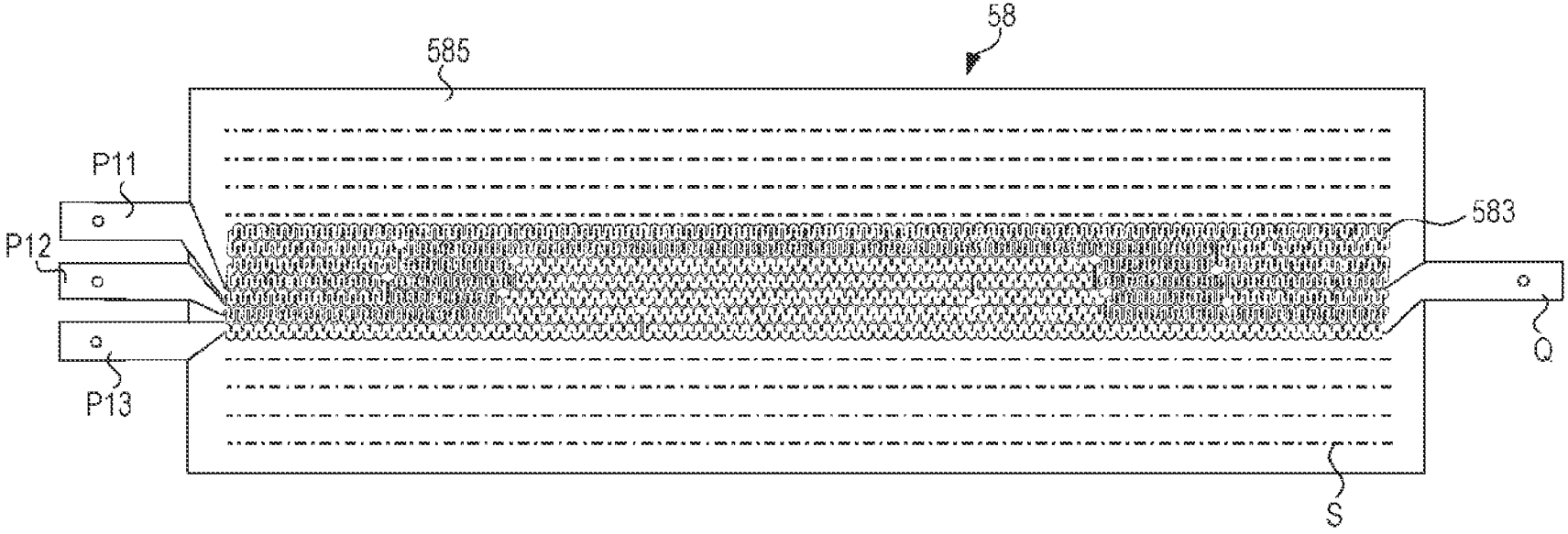
FIG. 5A illustrates arrangement of slits according to an exemplary embodiment of the present invention.
Figure 5B:
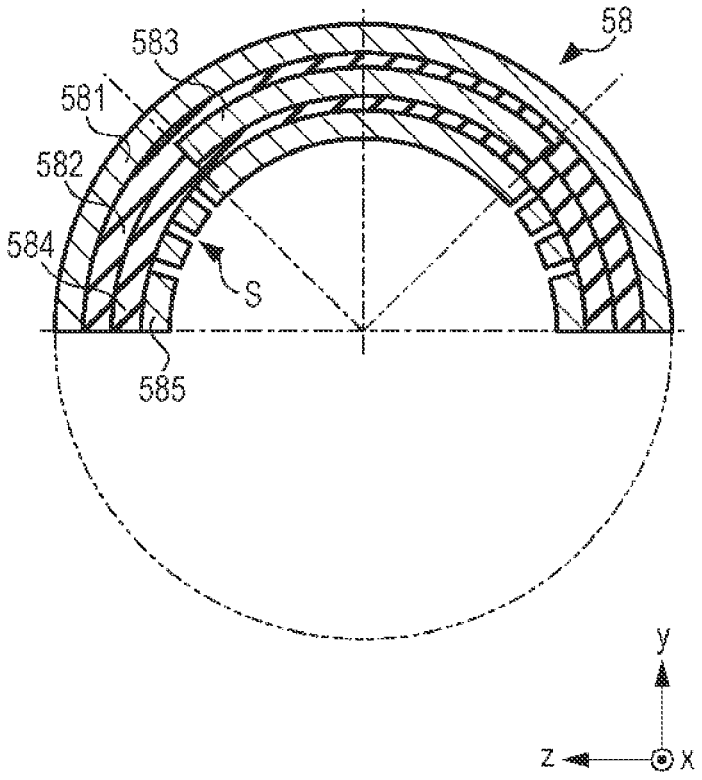
FIG. 5B illustrates the arrangement of the slits according to the exemplary embodiment of the present invention.

FIGS. 5A and 5B illustrate arrangement of the slits according to the exemplary embodiment of the present invention. Specifically, FIG. 5A is a view of the metal layers 583 and 585 seen in a similar or the same direction as that of FIG. 3 with the fixing belt 51, the metal layer 581, the insulation layer 582, and the insulation layer 584 omitted, and FIG. 5B is an enlarged sectional view of the heating member 58. FIGS. 5A and 5B illustrate the slits arranged in a similar or the same manner as that of FIGS. 4A and 4B. Similarly to or in the same manner as those according to the comparative example illustrated in FIGS. 4A and 4B, the slits S according to the exemplary embodiment extend in the longitudinal direction of the heating member 58 and the plural slits S are arranged in the circumferential direction of the heating member 58. Despite this, referring to FIGS. 5A and 5B, the slits S are provided in regions not superposed on the metal layer 583 when seen in the direction normal to the inner circumferential surface of the heating member 58 unlike the comparative example illustrated in FIGS. 4A and 4B. In the case where the slits S are not superposed on the metal layer 583 as described above, the likelihood of the metal layer 585 being separated from the insulation layer 584 from the slits S when the heating portion 831 generates heat may be reduced compared to the structure of FIGS. 4A and 4B. This may reduce the likelihood of the occurrences of problems such as abnormal heat generation by the heating portion 831 and poor contact of the temperature sensor due to the separation of the metal layer 585. The total of the widths of the slits S in the z axis direction may be the arc length difference or more so that the slits S compensate for the arc length difference between the outer circumferential surface and the inner circumferential surface of the heating member 58. For example, when the arc length difference is 0.6 mm and the width of each of the slits S is 0.1 mm, six or more slits S may be provided.

Although the exemplary embodiment of the present invention has been described, exemplary embodiments of the present invention are not limited to the above-described exemplary embodiment and may be implemented in a variety of other exemplary embodiments. Examples of the other embodiments are as follows. It is noted that the following forms may be combined.

(1) The slits S may be provided in the region superposed on the metal layer 583. The slits S may be provided in the region superposed on the metal layer 583 as long as, for example, the number of slits S formed in the regions not superposed on the metal layer 583 is greater than the number of slits S formed in the region superposed on the metal layer 583. In another example, the slits S may be provided in regions superposed on the non-heating portion 832 and 833 and in a region superposed on the heating portion 831 as long as the number of slits S formed in the regions not superposed on the heating portion 831 is greater than the number of slits S formed in the region superposed on the heating portion 831.

(2) The number, the width, and the shape of the slits S are not limited to those described in the exemplary embodiment. For example, the metal layer 585 may have a single slit S. In this case, the slit S is formed in a region not superposed on the metal layer 583 when seen in the direction normal to the inner circumferential surface of the heating member 58. In another example, the slits S may have a curved shape instead of the straight shape. Furthermore, the slits S may be inclined relative to the longitudinal direction of the heating member 58. In yet another example, the slits S may be split in the longitudinal direction of the heating member 58.

(3) The slits S are not necessarily provided in the metal layer 585. The slits S may be provided in the metal layer 581. Furthermore, the slits S may be provided in both the metal layers 581 and 585.

(4) The structure of the fixing unit 15 is not limited to that described in the exemplary embodiment. For example, the metal layers 581 and 585, the insulation layers 582 and 584, and the metal layer 583 are bonded to one another in both the heating region and non-heating regions. In another example, the metal layers 581 and 585, the insulation layers 582 and 584, and the metal layer 583 are mechanically secured at the non-heating regions by securing members such as screws. In another example, although the metal layer 583 includes the heating portion 831 and the non-heating portions 832 and 833 in the exemplary embodiment, the metal layer 583 does not necessarily include, for example, the non-heating portions 832 and 833. The materials of the layers included in the heating member 58 are not limited to those described in the exemplary embodiment.

(5) The image forming apparatus that includes the fixing unit 15 is not limited to the tandem-type image forming apparatus of the above-described exemplary embodiment. The image forming apparatus may be of a rotary type or may have any other structure. The image forming apparatus that includes the fixing unit 15 is not limited to the image forming apparatus that forms an image by superposing toner images of plural colors. The image forming apparatus may form a monochrome toner image.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A surface heater comprising:

a heating body;

insulation layers between which the heating body is interposed; and a first support layer and a second support layer between which the heating body and the insulation layers are interposed, wherein the first support layer has a first region superposed on the heating body and a second region not superposed on the heating body, wherein the first support layer has at least one slit which is located at a side of an inner circumferential surface of the surface heater bent into an arc shape, and wherein the second region has the at least one slit and the first region has no slit, or the at least one slit includes a plurality of slits and the second region has a greater number of slits out of the plurality of slits than the first region has.

2. A fixing device comprising:

face heater according to claim 1; and a belt, wherein the second support layer has a surface, the surface located at a side of an outer circumference of the surface heater bent into the arc shape, and wherein the belt is in contact with the surface of the second support layer and transports a recording medium on which an unfixed image to be fixed to the recording medium by heating is formed.

3. The fixing device according to claim 2, wherein the second region has the at least one slit and the first region has no slit.

4. The fixing device according to claim 2, wherein the at least one slit includes the plurality of slits and the second region has a greater number of slits out of the plurality of slits than the first region has.

5. The fixing device according to claim 2, wherein the at least one slit is formed on an inner circumferential surface of the first support layer bent into an arc shape.

6. The fixing device according to claim 2, wherein the plurality of slits are formed on an inner circumferential surface of the first support layer bent into an arc shape.

7. The fixing device according to claim 2, wherein the at least one slit includes the plurality of slits, wherein the plurality of slits extend in a second direction that intersects a first direction in which the belt transports the recording medium, wherein the plurality of slits are arranged in a circumferential direction of the surface heater, and wherein a total of widths of the plurality of slits in the circumferential direction is equal to or greater than a difference in length in the circumferential direction between the inner circumferential surface and an outer circumferential surface of the surface heater bent into the arc shape.

8. An image forming apparatus comprising:

a surface heater that includes a heating body, insulation layers between which the heating body is interposed, and a first support layer and a second support layer between which the heating body and the insulation layers are interposed;

an image forming section that forms on a recording medium an unfixed image to be fixed to the recording medium by heating; and a belt, wherein the second support layer has a surface, the surface located at a side of an outer circumference of the surface heater bent into an arc shape, wherein the belt is in contact with the surface of the second support layer and transports a recording medium on which an unfixed image to be fixed to the recording medium by heating is formed, wherein the first support layer has a first region superposed on the heating body and a second region not superposed on the heating body, wherein the first support layer has at least one slit which is located at a side of an inner circumferential surface of the surface heater bent into the arc shape, and wherein the second region has the at least one slit and the first region has no slit, or the at least one slit includes a plurality of slits and the second region has a greater number of slits out of the plurality of slits than the first region has.

* * * * *